US006116327A

United States Patent [19]

Beighton

[11] Patent Number: 6,116,327

[45] Date of Patent: Sep. 12, 2000

[54] MAKING A METAL SHAPE BY CASTING

[75] Inventor: David Patrick Beighton, Sheffield, United Kingdom

[73] Assignee: F.V.C. Limited, Sheffield, United Kingdom

[21] Appl. No.: 09/077,621

[22] PCT Filed: Nov. 6, 1996

[86] PCT No.: PCT/GB96/02715

§ 371 Date: Aug. 5, 1998

§ 102(e) Date: Aug. 5, 1998

[87] PCT Pub. No.: WO97/17150

PCT Pub. Date: May 15, 1997

[30] Foreign Application Priority Data

Nov. 7, 1995 [GB] United Kingdom ..... 9522741

[51] Int. Cl.[7] ..... B22C 7/00; B22C 9/04; B22C 1/02

[52] U.S. Cl. ..... 164/45; 164/519; 164/516

[58] Field of Search ..... 164/45, 519, 516, 164/34, 114

[56] References Cited

U.S. PATENT DOCUMENTS

| | | | |
|---|---|---|---|
| 4,682,643 | 7/1987 | Bernhardt et al. | 164/45 |
| 5,630,465 | 5/1997 | Feagin | 164/519 |
| 5,712,435 | 1/1998 | Feagin | 164/519 |
| 5,738,819 | 4/1998 | Feagin | 164/45 |

FOREIGN PATENT DOCUMENTS

| | | |
|---|---|---|
| 704724 | 3/1965 | Canada . |
| 0052997 | 5/1986 | European Pat. Off. . |
| 0115402 | 8/1989 | European Pat. Off. . |
| 1384487 | of 0000 | France . |
| 2236537 | of 0000 | Germany . |
| 136138 | 6/1990 | Germany . |
| 1401239 | 7/1975 | Japan . |
| 53-102830 | 9/1978 | Japan . |
| 78-74860 | 9/1978 | Japan . |
| 55-1553648 | 11/1980 | Japan . |
| 56-023356 | 3/1981 | Japan . |
| 59-10444 | 7/1982 | Japan . |
| 58-212835 | 12/1983 | Japan . |
| 60-261657 | 12/1985 | Japan . |
| 1061634 | 3/1967 | United Kingdom . |
| 1362346 | 8/1974 | United Kingdom . |
| 2050220 | 1/1981 | United Kingdom . |
| 2148760 | 6/1985 | United Kingdom . |
| WO 80/02811 | 12/1980 | WIPO . |

*Primary Examiner*—Patrick Ryan
*Assistant Examiner*—Anjan Dey
*Attorney, Agent, or Firm*—Marshall, O'Toole, Gerstein, Murray & Borun

[57] ABSTRACT

A method of making a metal shape comprising the steps of supplying molten metal into a ceramic shell mould mounted in a container, spinning the container and the shell mould therein about an axis and permitting the metal to solidify in the shell mould and thereafter removing, for example by breaking, the shell mould to expose the metal shape. The ceramic shell moulds made by providing a pattern of flexible elastically deformable material of a required shape and supported on a mandrel, applying at least one coating of hardenable refractory material to said pattern to form a rigid shell and removing the mandrel from supporting relationship with the pattern and subsequently removing the pattern from the shell by elastically deforming the pattern. The pattern is made by moulding said material in a master mould of a required shape and removing the pattern from the master mould, after the pattern has set, by elastically deforming the pattern.

29 Claims, 5 Drawing Sheets

MAKING A METAL SHAPE BY CASTING

DESCRIPTION OF INVENTION

This invention relates to making a metal shape by casting.

It is well known to make a metal shape by a centrifugal casting process in which molten metal is poured into a hollow mould which is rotating. Centrifugal casting provides the advantage of achieving segregation of impurities towards the axis of rotation and away from the external surface of the casting since impurities generally encountered are of lower density than the metal of the casting. Moreover, centrifugal casting enables the production of hollow cast shapes of controlled wall thickness without the need for central cores although, if desired, the rotating mould can be filled sufficiently so as to provide a shape without a central cavity. In either case the part of the casting containing the impurities can be removed, for example by machining.

Hitherto such centrifugal casting has been used with permanent moulds for metal shapes of relatively simple external surface configuration such as generally cylindrical. By providing a sand mould of appropriate shape within a container, generally made of steel, the external surface of the casting may be provided with a more complex configuration, within constraints imposed by the difficulty, complexity and expense of removing rigid patterns, typically of wood, for producing the sand mould, even when the rigid patterns are made collapsible to facilitate removal.

There is a demand for metal shapes, particularly hollow shapes such as gas turbine engine casings, having an external shape of relatively high complexity and precision than it has hitherto been possible, or economically possible, to manufacture by centrifugal casting.

Objects of the invention are to provide a method of making a metal shape in which the above mentioned problems are overcome or are reduced together with a method of making a mould capable of use in such a method and a method of making a pattern capable of use in making such a mould as well as apparatus capable of use in these methods.

According to one aspect of the present invention we provide a method of making a pattern of flexible elastically deformable material comprising the steps of moulding said material in a master mould of a required shape and removing the pattern from the master mould, after the pattern has set, by elastically deforming the pattern.

The method may include the step of moulding the material in a master mould which has a mould cavity defined between inner and outer parts and removing the inner part from within the outer part after the pattern has set and then removing the pattern from the outer part by elastically deforming the pattern.

The mould cavity may be of generally tubular configuration.

The inner part may comprise at least two portions and the method may include the step of separating said portions to remove the inner part from within the outer part.

The inner part may be provided with a plurality of retaining elements which extend into the mould cavity from the surface of the inner part so as to be embedded in the pattern.

The retaining elements may be releasably mounted on the inner part and the method may include the step of releasing the retaining elements from mounting relationship with the inner part.

The method may include the step of providing closure members at opposite ends of the mould cavity, at least one of said closure members being movable relative to at least one of said inner and outer parts.

The pattern may have a high elastic deformation memory so as to regain its shape within ±0.01 mm after elastic deformation up to 10× its original size.

The pattern may comprise a silicone rubber.

According to a second aspect of the present invention we provide a method of making a ceramic shell mould comprising providing a pattern of flexible elastically deformable material of a required shape and supported on a mandrel, applying at least one coating of hardenable refractory material to said pattern to form a rigid shell and removing the mandrel from supporting relationship with the pattern and subsequently removing the pattern from the shell by elastically deforming the pattern.

The method may include the step of subjecting the refractory material to heat to harden the shell.

At least one additional coating of refractory material may be applied over the previous coating after removal of the pattern from the shell.

The pattern may be made according to the first aspect of the invention.

The pattern may be of generally tubular configuration.

The mandrel may be of generally tubular configuration.

The mandrel may comprise at least two portions and the method may include the step of separating said portions to remove the mandrel from within the shell mould.

The method may include the step of providing a closure member at one end of the mandrel to prevent access to the interior of the mandrel by the coating material.

The outer surface of the pattern may provide a mould surface having at least one re-entrant recess therein.

The mandrel may be provided with a plurality of retaining elements which extend into the pattern from the outer surface of the mandrel so as to be embedded in the pattern.

The retaining elements may be releasably mounted on the mandrel and the method may include the steps of engaging the retaining elements in mounting relationship with the mandrel prior to performing said at least one coating step and releasing the retaining elements from said mounting relationship with the mandrel, subsequent formation of said shell and prior to removal of the pattern from within the shell mould.

The retaining elements which are releasably mounted, simply mounted on the mandrel, may be embedded in the pattern prior to supporting the pattern on the mandrel.

The retaining elements may be provided by the retaining elements according to the first aspect of the invention, said retaining elements remaining in embedded in the pattern after separation of the pattern from the master mould.

The mandrel may be provided by the inner part of the mould according to the first aspect of the invention.

Alternatively, the mandrel may be provided separately from the inner part of the mould according to the first aspect of the invention but may have at least an external surface of the same or similar configuration as the internal surface of the pattern.

When the mandrel is provided by the inner part of the mould according to the first aspect of the invention the pattern is preferably mounted on the mandrel in the same position as it occupied when it was made.

According to a third aspect of the present invention we provide a method of making a metal shape comprising the steps of supplying molten metal into a ceramic shell mould mounted in a container, spinning the container and the shell mould therein about an axis and permitting the metal to solidify in the shell mould and thereafter removing, for example by breaking, the shell mould to expose the metal shape.

The container is preferably rotated about a vertical axis but may be rotated about a horizontal axis, or indeed, about an axis at any other inclination to the vertical.

The shell mould may be made according to the second aspect of the present invention.

When the shell mould is made according to the second aspect of the invention the pattern may be made by the first aspect of the invention.

The shell mould may be mounted in the container by locating the shell mould in the container and placing and compacting particulate material about the shell mould.

The particulate material may be compacted by vibration.

The particulate material may comprise iron or other ferrous metal particles.

An embodiment of the invention will now be described with reference to the accompanying drawings wherein.

Figure 1:
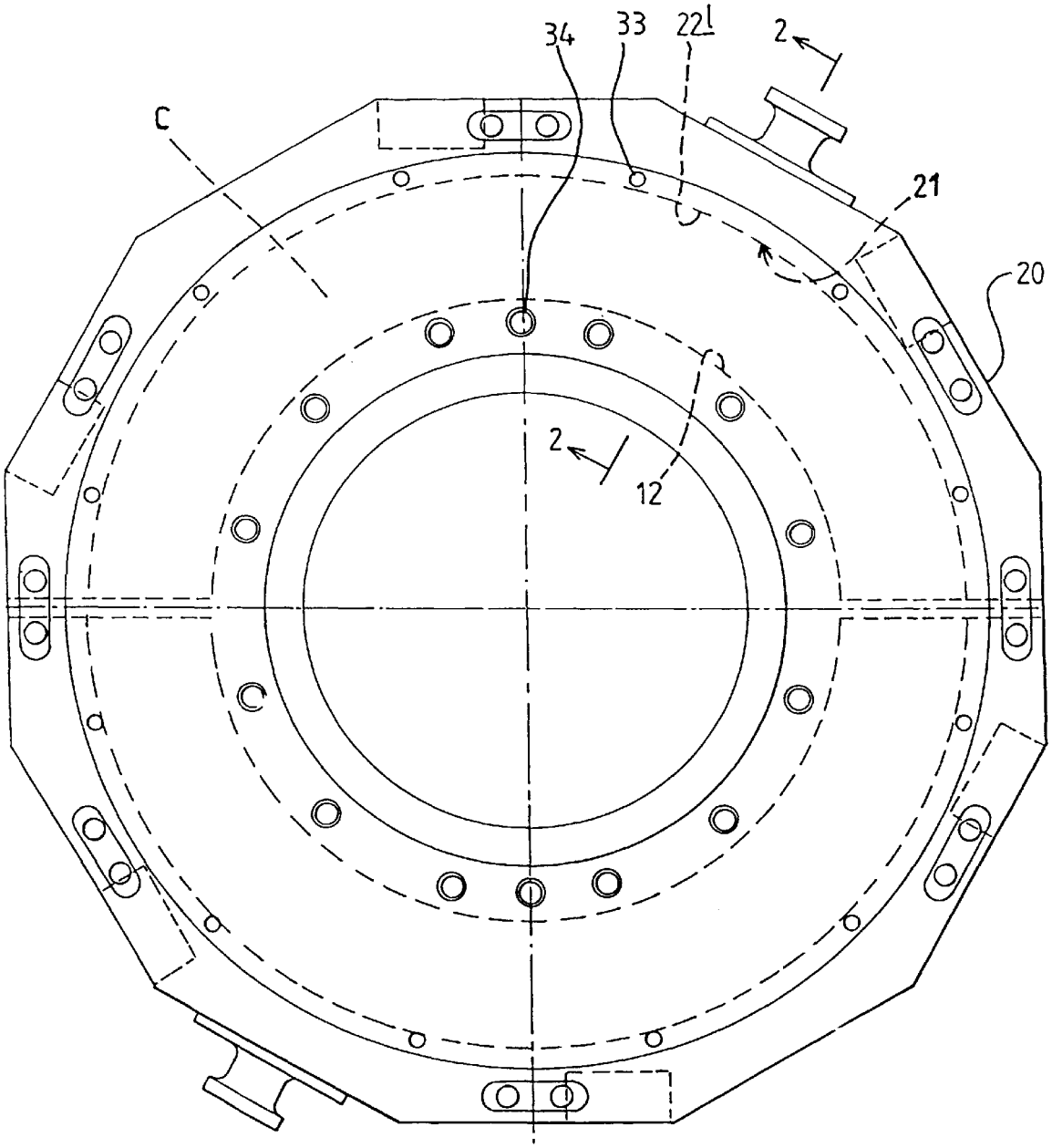
FIG. 1 is a plan view showing a master mould for use in a method embodying the invention.
Figure 2:
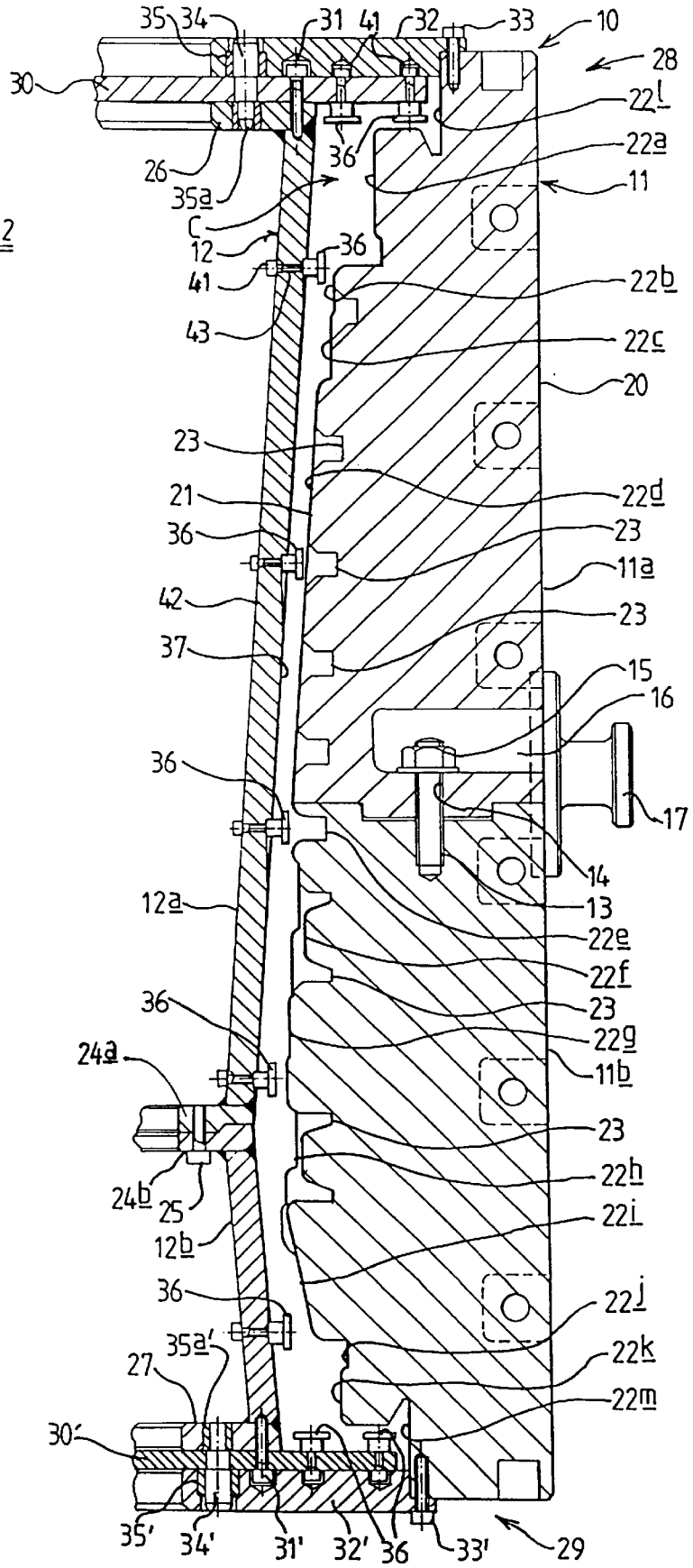
FIG. 2 is a fragmentary cross-section to an enlarged scale on the line 2—2 of FIG. 1.
Figure 3:
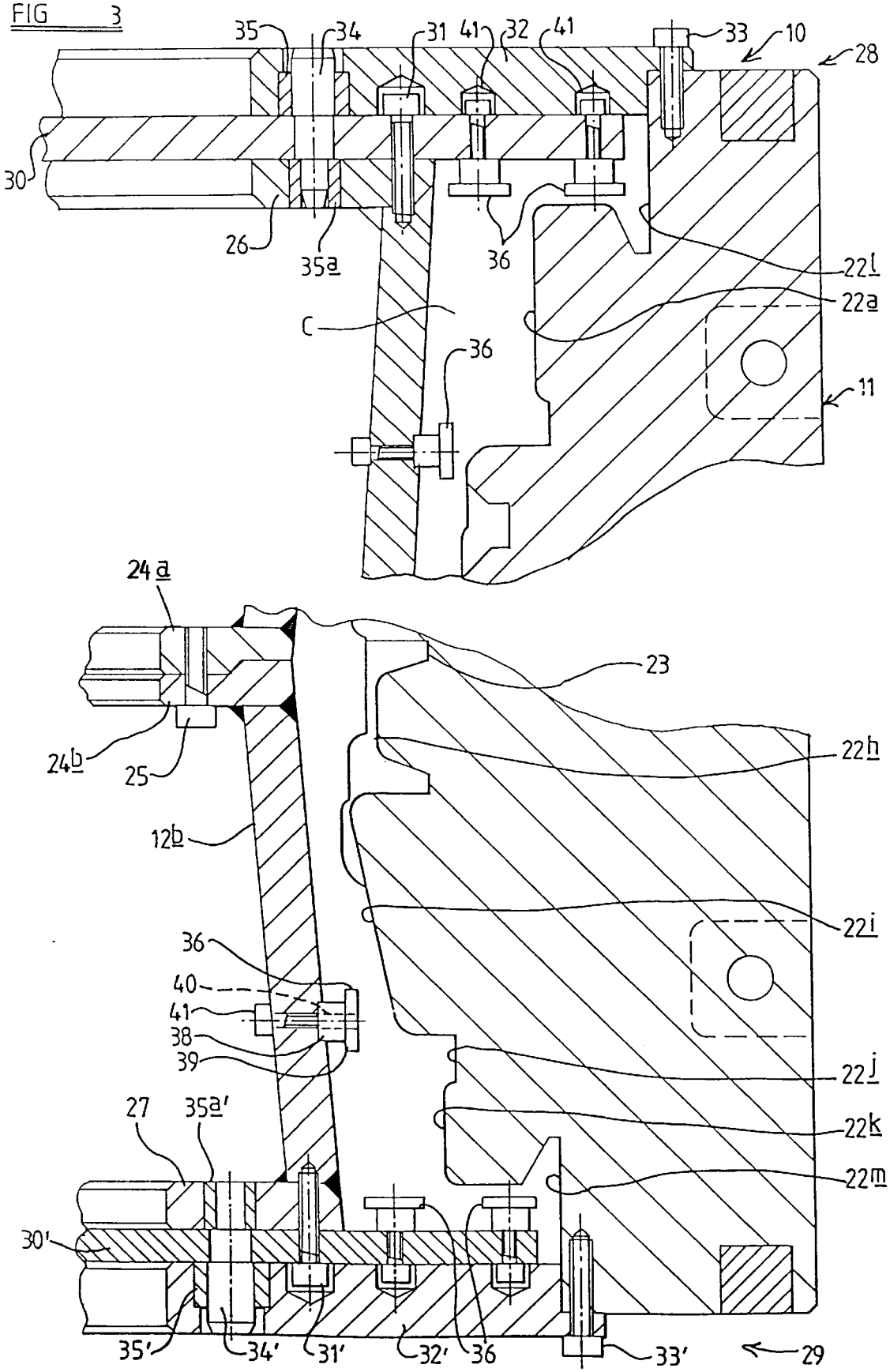
FIG. 3 is a view of part of FIG. 2, drawn to an enlarged scale, with parts omitted.

Referring now to FIGS. 1 to 3, a master mould is indicated generally at 10 and comprises a generally tubular outer part or die 11 and a generally tubular inner part 12 which define a mould cavity C therebetween.

The outer part 11 is split longitudinally and thus comprises two portions 11*a*, 11*b* which are connected together by studs 13 threadedly engaged with the lower mould portion 11*b* and passing through an opening 14 in the upper mould portion 11*a* with a nut 15 being engaged with the stud and access thereto being provided by a slot 16 in the upper mould part 11. This enables the separation of the two portions to be adjusted by means of shims if required. Alternatively, if desired, the outer part 11 may be a one piece element.

A pair of bosses 17 are provided at diametrically opposite positions for engagement by a crane or other lifting means to facilitate handling of the master mould.

In the present example the master mould 10 has an external surface 20 which, in plan view as best shown in FIG. 1, is of twelve sided polygonal configuration, and an internal surface 21 of generally cylindrical configuration but having a detailed configuration, shown in FIG. 2, having a plurality of longitudinal areas some of which are indicated at 22*a*–*m* and some of which, as indicated at 22*l* & *m*, are of re-entrant configuration. Some of the areas are also provided with localised or part circumferentially extending recesses such as indicated at 23.

The internal surface 21 is machined to a high precision, for example to a tolerance of ±0.05 mm.

The inner part 12 is likewise made in two longitudinal separate and connected together portions 12*a*, 12*b*, the portions 12*a* and 12*b* being provided with an annular inwardly directed flange 24*a*, 24*b* respectively and the flanges being interconnected by circumferentially disposed bolts 25.

The inner mould portions 12*a*, 12*b* are of generally frusto-conical configuration having their smaller diameter ends releasably connected together by the bolts 25 so that the mould portions 12*a*, 12*b* can be removed from within the outer mould part 11 by undoing the bolts 25 and withdrawing the inner mould portions 12*a*, 12*b* from opposite ends of the outer mould part 11, the portions of which remain interconnected.

At their larger diameter ends the inner mould portions 12*a*, 12*b* have further inwardly directed annular flanges 26, 27 at the, in use, upper and lower ends 28, 29 of the master mould respectively. The flange 26 has a circular plate 30 releasably fastened thereto by bolts 31 whilst an annular die closure plate 32 is bolted to the upper end of the outer mould portion 11*a* by further bolts 33. Locating pin 34 and associated sleeves 35, 35*a* are provided to locate the die closure plate and annular plate 30 accurately relative to the flange 26.

A similar arrangement is provided at the bottom end 29 of the master mould 10 where similar components have been designated by similar reference numerals but with the addition of a prime sign.

The inner mould part 12 is provided with a plurality of retaining elements 36 which extend into the mould cavity C from an outwardly facing surface 37 of the inner mould part 12. Each retaining element comprises a stud having a generally cylindrical boss part 38 and a generally circular disc shaped head part 39 with a central threaded bore 40 extending therethrough in which, in use, a socket screw 41 is threadedly received. The outwardly facing surface 37 and an inwardly facing surface 42 of the inner mould part 12 are provided with recesses with provide seats for the underside of the head of each socket screw 41 and for an end surface of the boss part 38 with a bore 43 extending through the wall of the inner mould part 12 for the socket screw 41. Retaining elements 36 of the same configuration are similarly mounted on the end plates 30, 35.

In use, a suitable settable material is introduced into the mould cavity C in flowable form through an appropriate feed passage or passages, not shown, so as to completely fill mould cavity C and so that the retaining elements 36 become embedded in a pattern P which is formed when the material sets.

The pattern is made of any suitable, flexible, elastically deformable material having a sufficiently high memory of its as moulded shape so as to return to that shape with high accuracy after elastic deformation. For example, so as to regain its shape to within ±0.01 mm after elastic deformation up to 10× its original size.

One suitable material is silicone rubber such as RTV-2 silicone rubber manufactured by Wacker and known as "Elastosil M4601".

This is a pourable, addition-curing two-component silicone rubber which can be vulcanised at room temperature; good flowability; a rapid and non-shrink cure at room temperature; a low Shore A hardness (approximately 26); high tear resistance and outstanding long-term stability of the mechanical properties of the vulcanisate.

The rubber of the present example has the following properties.

| | | | |
|---|---|---|---|
| Density at 23° C., in water | DIN 52 479 A | $g/cm^3$ | 1.13 |
| Hardness Shore A | DIN 53 505 | | 26 |
| Tensile strength | DIN 53 504 S3 | $N/mm^2$ | 6.0 |
| Elongation at break | DIN 53 504 S3 | % | 450 |
| Tear resistance | ASTM D 624 B | N/mm | ≧20 |
| Linear shrinkage | | % | <0.1 |
| Coefficient of linear expansion | 0–150° C. | m/m K | $2.4 \times 10^{-4}$ |

If desired, the die may be disposed on a rotating table and the die rotated after the die has been filled with rubber so that any bubbles or other less dense impurities migrate away from the outer surface of the pattern thereby ensuring absence of surface defects. If desired, the die may be rotated whilst it is being filled or the die may be stationary whilst it is being filled. Further alternatively the die may be disposed in a vacuum chamber so that gaseous impurities are extracted from the pattern material. Again, the die may be exposed to a vacuum only after pouring or, alternatively, both during pouring and after pouring. Further alternatively, both of the above described rotating and vacuum extraction operations may be performed.

After the rubber has set and appropriately cured the bolts 33 are released and the die closure plate 32 is removed. The socket screws 41 associated with the plate 30 are unscrewed from the retaining elements 36 and removed from the plate 30. Then the bolts 31 are unscrewed and the plate 30 removed. The socket screws 41 associated with the upper inner mould portion 12*a* are then removed. The master mould assembly is then turned over using the bosses 17 so that the bottom end 29 is now uppermost and then the same sequence is repeated as described above. That is to say, the bolts 33' are unscrewed and the plate 32' removed following which socket screws 41 associated with the plate 30' are unscrewed from the retaining elements 36 and removed. Then the bolts 31' are unscrewed and the plate 30' removed. The socket screws 41 associated with the lower inner mould portion 12*b* are then removed.

The bolts 25 are then unscrewed to enable the inner mould portion 12*b* to be removed from the mould assembly and then the mould assembly is again turned over to return it to its original position and the upper inner mould portion 12*a* removed.

Thereafter, the pattern which has been moulded in the cavity C is peeled away from the inwardly facing surface 21 of the outer mould part 11.

Figure 4:
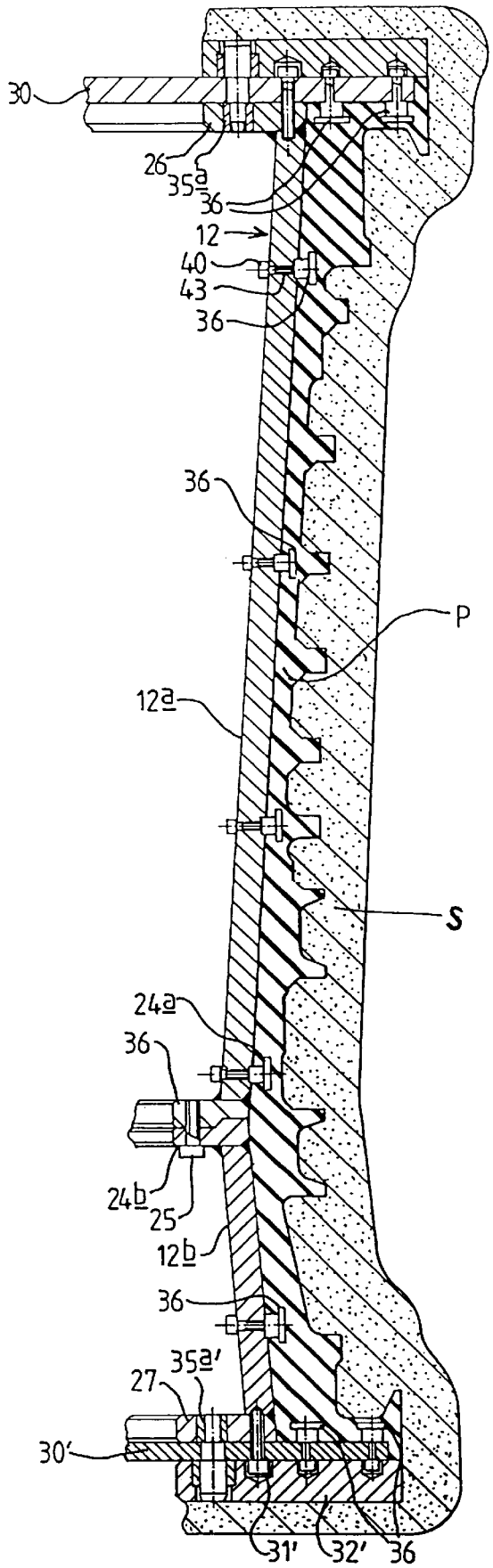
FIG. 4 is a cross-section similar to that of FIG. 3 but showing a stage in the manufacture of a shell mould embodying the invention.

Referring now to FIG. 4, thereafter, the pattern is re-located on the upper inner mould portion 12*a* in the identical position to that in which it was moulded so that the retaining elements which have remained embedded in the pattern are aligned with the respective passages 43. The socket screws 41 associated with the upper inner mould portion 12*a* are then replaced and tightened. The lower inner mould portion 12*b* is then introduced into the bore of the pattern, again in the same orientation as that which it occupied during moulding, and the bolts 25 are tightened to connect the upper and lower inner mould portions 12*a* and 12*b* together. Socket screws 41 associated with the lower inner mould portion 12*b* are then replaced and tightened. Plate 30' is then attached to the inner mould part 12 by tightening bolts 31'. The inner mould part 12 now constitutes a mandrel to reinforce and support the pattern and hence will hereinafter be referred to as such. Socket screws 41 are then tightened into the retaining elements associated with the plate 30' of the mandrel. The assembly is then turned over and the plate 30 is fastened in place by tightening bolts 31. Socket screws 41 are then tightened into the retaining elements 36 associated with the upper mandrel portion 12*a* and associated plate 30.

A suitable form of protection is then applied to protect the plate 30 and associated bolts and the socket screws during a Subsequent shell mould making operation.

If desired, the mandrel used in this step of the process may be provided separately from the inner parts of the mould used to make the pattern but of course with the sealable corresponding shape which may be the same as each of the inner mould part or modified as desired.

The thus prepared pattern assembly is then mounted on a conventional shelling machine and a plurality of coatings of a suitable ceramic material are applied in conventional manner.

Accordingly, a primary coat of zircon and/or molochite bonded with a silica sol, or pre-hydrolised ethyl silicate i.e. a suspension of silica in a liquid, is applied and a stucco of alumina or zircon and/or alumino silicate is applied. Thereafter further coats are applied, typically using only alumino silicate, and using a coarser aggregate as the number of coats increases. Typically twelve to sixteen coats are applied.

During the shell making process suitable reinforcing material such as circumferentially extending high tensile metal wire, for example nickel or stainless steel, is applied for example by spiral wrapping.

When a resultant shell S has dried sufficiently for it to become rigid excess shell material is removed from the end plates and the mandrel is separated from within the rubber pattern by carrying out the disassembly procedure described hereinbefore in connection with the pattern-making operation. When the mandrel has been removed the rubber pattern is peeled away from the shell S.

Thereafter the shell is fired in conventional manner, for example at about 1,000° C. for about two hours, although the temperature and time depends upon the particular size and thickness and configuration of the shell.

The firing operation may be carried out by placing the shell in a cold furnace and heating under a predetermined temperature increase regime or it can be put into a hot furnace depending upon the configuration and chemical composition of the shell, all in conventional manner.

Figure 5:
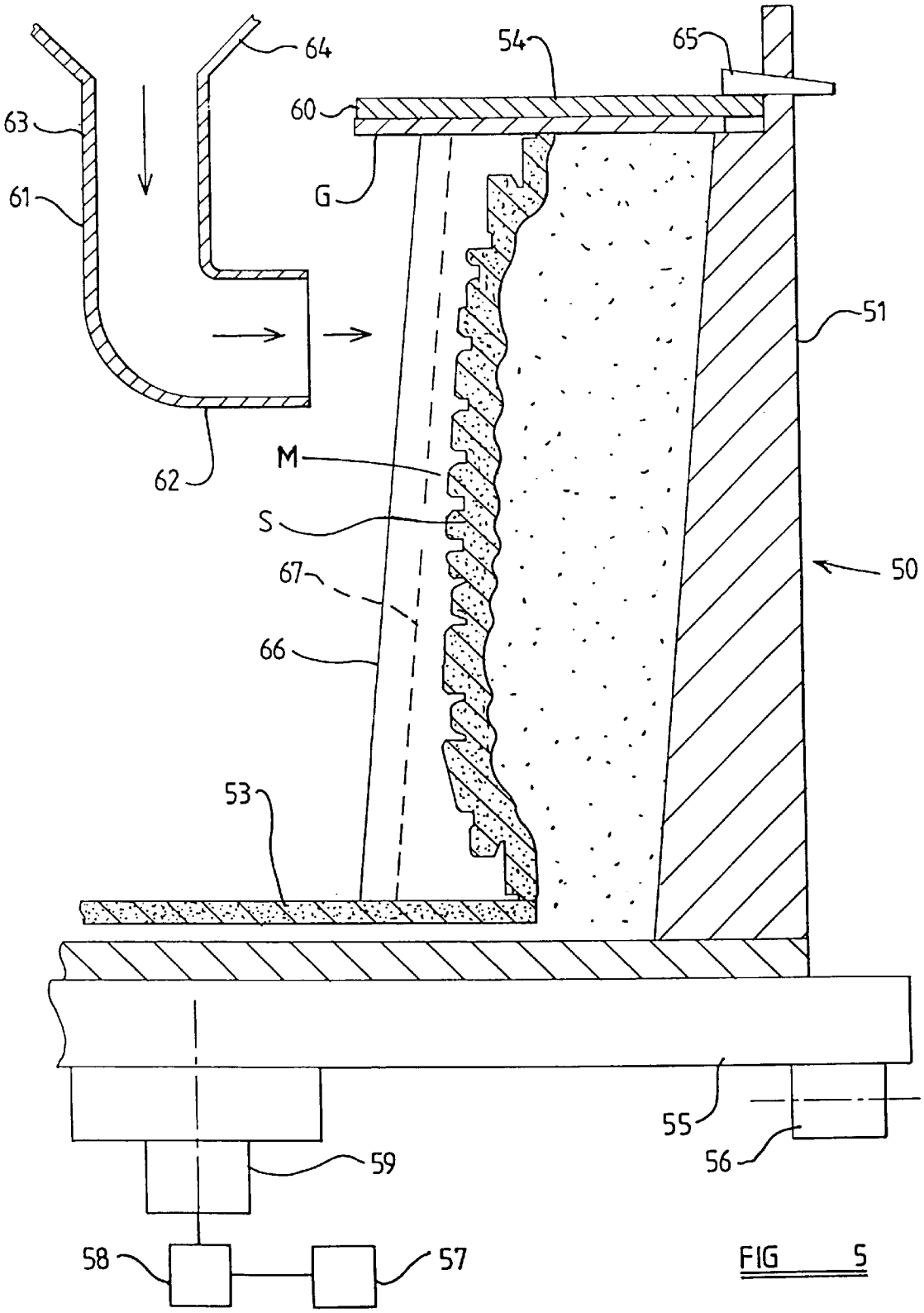
FIG. 5 is a diagrammatic cross-section through a centrifugal casting apparatus for use in a method of making a metal shape embodying the invention.

Referring now to FIG. 5, the thus fired shell S is subsequently positioned in a steel container 50 of generally cylindrical external configuration and having an inner wall 51 of inwardly and downwardly tapered configuration and approximately two inches larger than the maximum size of the shell. The space between the shell S and the inner cylindrical wall 51 of the container is filled with a bonded granular material. In the present example a material having good thermal conductivity is used, for example iron grains, so as to extract heat from the metal casting. This is done in the present example because the casting concerned requires a particular grain structure which necessitates a relatively high rate of heat extraction. Of course, if desired in any particular case, other supporting material may be used, such as bonded sand.

The hereinbefore described particulate material may be bonded using resin bonding but if it is desired to pre-heat the container and shell to above the temperature recommended by the resin manufacturer an alternative bonding system may be used. For example, bonding may be carried out using a sodium silicate bonding material since it is more stable at high temperature.

Prior to introducing the shell into the container suitable end plates 53, 54 are provided.

The container is supported on a rotating turntable 55 which may be stabilised by rollers 56 and driven by a motor 57 through a gearbox 58 and central drive shaft 59, all in conventional manner. The container and the shell therein is rotated to a suitable speed, to provide a centripetal force of, for example 30–50 g when the container is spun about a vertical axis as illustrated in FIG. 4, or if the container is rotated about a horizontal axis, up to, for example, 140 g.

The molten metal is poured into the shell through a pouring opening 60 in the top plate 54. In the illustrated example the top plate 54 is made of steel and the bottom plate 53 is made of ceramic material.

The metal is poured in through a runner 61 having a spout part 62 extending generally horizontally at right angles to the main part 63 of the runner, the upper end of which is provided with a funnel 64 for convenience in pouring from a ladle which may be supported by an overhead crane or in any other desired manner.

The runner 61 is preferably positioned generally as shown so as to direct metal adjacent to the spinning wall of the shell. However, if desired, it could be positioned at any other desired position longitudinally of the shell S. Furthermore, if desired, the runner could be a simple tube to discharge metal generally vertically downwardly adjacent the bottom end of the shell, but it is preferred to utilise the elbow shape of the runner system illustrated to minimise turbulence and chilling of the metal.

As illustrated, the end plate 54 is held in place by a plurality of tapered pegs 65 engaged in suitably shaped apertures at the upper end of the wall 51 of the container.

The casting takes a tapered internal shape as illustrated naturally.

After solidification the end plate 54 is removed and the assembly is then turned upside down and knocked out of the container 50, the tapered configuration of the internal surface of the wall 51 facilitating this.

The resultant metal shape M is then removed from the shell S generally by breaking the shell and thereafter a layer is machined away from the internal surface 66 of the metal shape along the dotted line illustrated at 67, thereby removing the part of the metal casting which contains impurities. In the present example the metal shape M is a casing for a gas turbine engine and is made of a martensitic stainless steel, but may also be used for vacuum prepared alloys in which case the centrifugal casting is carried out in a vacuum chamber.

I claim:

1. A method of making a pattern of flexible elastically deformable material comprising the steps of moulding said material in a mould cavity of a master mould of a required shape which has said mould cavity defined between inner and outer parts and removing the inner part from within the outer part after the pattern has set, and then removing the pattern from the outer part by elastically deforming the pattern, thereby removing the pattern from the master mould, wherein the inner part is provided with a plurality of retaining elements which extend into the mould cavity from the surface of the inner part so as to be embedded in the pattern.

2. A method according to claim 1 wherein the mould cavity is of generally tubular configuration.

3. A method according to claim 1 wherein the inner part comprises at least two portions and the method includes the step of separating said portions to remove the inner part from within the outer part.

4. A method according to claim 1 wherein the retaining elements are releasably mounted on the inner part and the method includes the step of releasing the retaining elements from mounting relationship with the inner part.

5. A method accordingly to claim 1 wherein the method includes the step of providing closure members at opposite ends of the mould cavity, at least one of said closure members being movable relative to at least one of said inner and outer parts.

6. A method according to claim 1 wherein the pattern has a high elastic deformation memory so as to regain its shape within ±0.01 mm after elastic deformation up to 10 times its original size.

7. A method according to claim 1 wherein the pattern comprises silicone rubber.

8. A pattern when made by a method according to any one of the preceding claims.

9. A method of making a ceramic shell mould comprising providing a pattern of flexible elastically deformable material of a required shape and supported on a mandrel, applying at least one coating of hardenable refractory material to said pattern to form a rigid shell and removing the mandrel from supporting relationship with the pattern and subsequently removing the pattern from the shell by elastically deforming the pattern and wherein the mandrel is provided with a plurality of retaining elements which extend into the pattern from the outer surface of the mandrel so as to be embedded in the pattern.

10. A method according to claim 9 wherein the method includes the step of subjecting the refractory material to heat to harden the shell.

11. A method according to claim 9 wherein at least one additional coating of refractory material is applied over the previous coating after removal of the pattern from the shell.

12. A method according to claim 9 wherein the pattern is made by a method comprising the steps of moulding said material in a master mould of a required shape and removing the pattern from the master mould, after the pattern has set, by elastically deforming the pattern.

13. A method according to claim 9 wherein the pattern is of generally tubular configuration.

14. A method according to claim 9 wherein the mandrel is of generally tubular configuration.

15. A method according to claim 9 wherein the mandrel comprises at least two portions and the method includes the step of separating said portions to remove the mandrel from within the shell mould.

16. A method according to claim 9 wherein the method includes the step of providing a closure member at one end of the mandrel to prevent access to the interior of the mandrel by the coating material.

17. A method according to claim 9 wherein the outer surface of the pattern provides a mould surface having at least one re-entrant recess therein.

18. A method according to claim 9 wherein the retaining elements are releasably mounted on the mandrel and the method includes the steps of engaging the retaining elements in mounting relationship with the mandrel prior to performing said at least one coating step and releasing the retaining elements from said mounting with the mandrel, subsequent to formation of said shell and prior to removal of the pattern from within the shell mould.

19. A method according to claim 9 wherein the retaining elements which are releasably mounted, on the mandrel, are embedded in the pattern prior to supporting the pattern on the mandrel.

20. A method according to claim 9 wherein the retaining elements are provided by retaining elements provided on the pattern by a method having the steps of moulding said material in a master mould of a required shape which has a mould cavity defined between inner and outer parts and removing the pattern from the master mould, after the pattern has set, by removing the inner part from within the outer part and then removing the pattern from the outer part, wherein the inner part is provided with a plurality of retaining elements which extend into the mould cavity from the surface of the inner part so as to be embedded in the pattern, wherein said retaining elements remain embedded in the pattern after separation of the pattern from the master mould.

21. A method according to claim 9 wherein the pattern is made by a method comprising the steps of moulding said material in a master mould of a required shape which has a mould cavity defined between inner and outer parts and removing the pattern from the master mould, after the pattern has set, by removing the inner part from within the outer part and then removing the pattern from the outer part, wherein the mandrel is provided by the inner part of the mould.

22. A method according to claim 9 wherein the pattern is made by a method comprising the steps of moulding said material in a master mould of a required shape which has a mould cavity defined between inner and outer parts and removing the pattern from the master mould, after the pattern has set, by removing the inner part from within the outer part and then removing the pattern from the outer part, wherein the mandrel is provided separately from the inner part of the mould.

23. A method according to claim 22 wherein the pattern has an internal surface and the mandrel his at least an external surface of the same or similar configuration as the internal surface of the pattern.

24. A method according to claim 21 wherein the pattern is mounted on the mandrel in the same position as it occupied when the pattern was made.

25. A ceramic shell mould when made by a method according to any one of claims 12 to 24.

26. A method of making a ceramic shell mould comprising providing a pattern of flexible elastically deformable material of a required shape and supported on a mandrel, applying at least one coating of hardened refractory material to said pattern to form a rigid shell and removing the mandrel from supporting relationship with the pattern and subsequently removing the pattern from the shell by elastically deforming the pattern, wherein the pattern is made by a method comprising the steps of moulding said material in a master mould of a required shape which has a mould cavity defined between inner and outer parts and removing the pattern from the master mould, after the pattern has set, by removing the inner part from within the outer part and then removing the pattern from the outer part, wherein the mandrel is provided by the inner part of the mould.

27. A method of making a ceramic shell mould comprising providing a pattern of flexible elastically deformable material of a required shape and supported on a mandrel, applying at least one coating of hardenable refractory material to said pattern to form a rigid shell and removing the mandrel from supporting relationship with the pattern and subsequently removing the pattern from the shell by elastically deforming the pattern, wherein the pattern is made by a method comprising the steps of moulding said material in a master mould of a required shape which has a mould cavity defined between inner and outer parts and removing the pattern from the master mould, after the pattern has set, by removing the inner part from within the outer part and then removing the pattern from the outer part, wherein the mandrel is provided separately from the inner part of the mould.

28. In a centrifugal casting process, including the steps of supplying molten metal into a ceramic shell mould mounted in a container, spinning the container and the shell mould therein about an axis and permitting the metal to solidify in the shell mould and thereafter removing, for example by breaking, the shell mould to expose the metal shape, wherein the ceramic shell mould is made by a method comprising the steps of:

providing a pattern of flexible elastically deformable material of a required shape and supported on a mandrel, applying at least one coating of hardenable refractory material to said pattern to form a rigid shell and removing the mandrel from supporting relationship with the pattern and subsequently, removing the pattern from the shell by elastically deforming the pattern and wherein the mandrel is provided with a plurality of retaining elements which extend into the pattern from the outer surface of the mandrel so as to be embedded in the pattern.

29. A method of making a metal shape comprising the steps of:

providing a ceramic shell mould by providing a pattern of flexible elastically deformable material of a required shape and supported on a mandrel, applying at least one coating of hardenable refractory material to said pattern to form a rigid shell and removing the mandrel from supporting relationship with the pattern and subsequently, removing the pattern from the shell by elastically deforming the pattern and wherein the mandrel is provided with a plurality of retaining elements which extend into the pattern from the outer surface of the mandrel so as to be embedded in the pattern;

supplying molten metal into the ceramic shell mould mounted in a container;

spinning the container and the shell mould therein about an axis and permitting the metal to solidify in the shell mould; and thereafter removing the shell mould to expose the metal shape.

* * * * *